US008950100B2

(12) United States Patent
Nebeker et al.

(10) Patent No.: US 8,950,100 B2
(45) Date of Patent: Feb. 10, 2015

(54) SLIDE TAKEDOWN SYSTEM AND METHOD FOR FIREARM

(71) Applicant: Sturm, Ruger & Company, Inc., Southport, CT (US)

(72) Inventors: Darin Nebeker, Gilbert, AZ (US); Amir Zonshine, Phoenix, AZ (US); James McGarry, Prescott Valley, AZ (US)

(73) Assignee: Sturm, Ruger & Company, Inc.

( * ) Notice: Subject to any disclaimer, the term of this patent is extended or adjusted under 35 U.S.C. 154(b) by 132 days.

(21) Appl. No.: 13/708,711

(22) Filed: Dec. 7, 2012

(65) Prior Publication Data

US 2014/0165442 A1 Jun. 19, 2014

Related U.S. Application Data

(60) Provisional application No. 61/568,783, filed on Dec. 9, 2011.

(51) Int. Cl.

| | |
|---|---|
| ***F41A 11/00*** | (2006.01) |
| ***F41C 27/00*** | (2006.01) |
| ***F41A 35/00*** | (2006.01) |
| ***F41A 3/64*** | (2006.01) |
| ***F41C 3/00*** | (2006.01) |

(52) U.S. Cl.

CPC . *F41A 35/00* (2013.01); *F41A 3/64* (2013.01); *F41A 11/00* (2013.01); *F41C 3/00* (2013.01)

USPC ..... 42/108; 42/70.08; 29/426.1

(58) Field of Classification Search

USPC ..... 42/108, 75.01, 75.02, 70.01–70.11, 90, 42/106; 89/1.1; 29/246.1

See application file for complete search history.

(56) References Cited

U.S. PATENT DOCUMENTS

| | | | | |
|---|---|---|---|---|
| 3,745,881 | A | | 7/1973 | Roy |
| 4,275,640 | A | | 6/1981 | Wilhelm |
| 4,361,975 | A | | 12/1982 | Wilhelm |
| 4,627,184 | A | | 12/1986 | Ruger et al. |
| 4,893,546 | A | * | 1/1990 | Glock ..... 89/145 |
| 5,259,138 | A | | 11/1993 | Scirica |
| 5,272,957 | A | | 12/1993 | Chesnut et al. |
| 5,419,069 | A | | 5/1995 | Mumbleau et al. |
| 5,531,040 | A | | 7/1996 | Moore |
| 5,669,169 | A | | 9/1997 | Schmitter et al. |
| 5,717,156 | A | | 2/1998 | Lenkarski |
| 5,741,996 | A | | 4/1998 | Ruger et al. |
| 5,753,848 | A | | 5/1998 | Kart |

(Continued)

OTHER PUBLICATIONS

International Search Report and Written Opinion dated Aug. 2, 2013 (PCT/US2012/068585).

*Primary Examiner* — Jonathan C Weber

(74) *Attorney, Agent, or Firm* — The Belles Group, P.C.

(57) ABSTRACT

A firearm with slide takedown mechanism and method for use is disclosed. In one embodiment, the firearm includes a frame, barrel, trigger and a reciprocating slide. A takedown lever is pivotably mounted to the firearm and engageable with the slide. In a first blocking position, the takedown lever engages and blocks the rearward path of the slide which is not movable beyond a first position. In a second unblocking position, the takedown lever is pivoted laterally outwards from the frame and disengages the slide. The rearward path of the slide is no longer blocked which may be moved to a second rearward removal position enabling a user to remove the slide and field strip the firearm. In one embodiment, the takedown lever is disposed underneath the frame. The firearm may be a semi-automatic pistol in some embodiments.

23 Claims, 17 Drawing Sheets

(56) References Cited

U.S. PATENT DOCUMENTS

| | | | | |
|---|---|---|---|---|
| 6,212,814 | B1 | 4/2001 | Lambie | |
| 6,234,059 | B1 | 5/2001 | Fuchs et al. | |
| 6,266,909 | B1 | 7/2001 | Fuchs et al. | |
| 6,405,631 | B1 | 6/2002 | Milek | |
| 6,591,536 | B2 | 7/2003 | Houde-Walter et al. | |
| 6,993,864 | B1 | 2/2006 | O'Clair et al. | |
| 7,140,141 | B2 | 11/2006 | Vaid | |
| 7,337,571 | B2 | 3/2008 | McGarry | |
| 7,343,706 | B2 | 3/2008 | McGarry | |
| 7,392,611 | B2 | 7/2008 | Curry | |
| 7,661,219 | B1 | 2/2010 | Knight et al. | |
| 7,823,314 | B1 | 11/2010 | Wheatley | |
| 7,937,876 | B1 | 5/2011 | Graham | |
| 8,006,609 | B2 | 8/2011 | Kallio et al. | |
| 8,245,427 | B2 * | 8/2012 | Gomez | 42/70.08 |
| 8,371,058 | B2 * | 2/2013 | Trpcic | 42/108 |
| 8,495,832 | B2 * | 7/2013 | Vukovic | 42/70.02 |
| 2003/0066228 | A1 | 4/2003 | Smith | |
| 2004/0007124 | A1 | 1/2004 | Nakatani | |
| 2004/0244254 | A1 | 12/2004 | Barfield et al. | |
| 2005/0115399 | A1 | 6/2005 | Vaid | |
| 2005/0188592 | A1 | 9/2005 | Spinner et al. | |
| 2005/0257413 | A1 | 11/2005 | Zimmermann | |
| 2006/0064914 | A1 | 3/2006 | Greer | |
| 2006/0249014 | A1 | 11/2006 | Curry | |
| 2009/0071053 | A1 | 3/2009 | Thomele et al. | |
| 2009/0199450 | A1 | 8/2009 | Storch | |
| 2009/0282718 | A1 | 11/2009 | Bartley | |
| 2010/0170132 | A1 | 7/2010 | Zukowski | |
| 2010/0269394 | A1 * | 10/2010 | Ketchum | 42/108 |
| 2010/0300277 | A1 | 12/2010 | Hochstrate et al. | |
| 2010/0313459 | A1 | 12/2010 | Gomez | |
| 2010/0319233 | A1 | 12/2010 | Wray | |
| 2011/0061284 | A1 | 3/2011 | Cabahug et al. | |
| 2011/0088539 | A1 | 4/2011 | Oz | |
| 2011/0126441 | A1 | 6/2011 | Vukovic | |
| 2011/0162248 | A1 * | 7/2011 | Trpcic | 42/108 |
| 2011/0162249 | A1 | 7/2011 | Woodmansee et al. | |

* cited by examiner

SLIDE TAKEDOWN SYSTEM AND METHOD FOR FIREARM

CROSS-REFERENCE TO RELATED APPLICATIONS

The present application claims the benefit of priority to U.S. Provisional Application No. 61/568,783 filed Dec. 9, 2011, which is incorporated by reference herein in its entirety.

BACKGROUND OF THE DISCLOSURE

The present disclosure generally relates to firearms, and more particularly to a slide takedown system and method of use for pistols.

Semi-automatic pistols generally include a frame having a grip portion for grasping by the user, barrel defining a chamber for holding a cartridge, firing mechanism for cocking and releasing a striker or hammer to detonate the cartridge, and an axially reciprocating slide supported by the frame. The slide defines a breech block for forming an openable and closeable breech with the rear of the chamber as well known to those skilled in the art.

Disassembly or "field stripping" of semi-automatic pistol for inspection and maintenance requires removal of the slide from the pistol. Removal of the slide is prevented during normal operation of the pistol when in the ready-to-fire condition. To allow the slide to be removed, various approaches to takedown mechanisms or systems may be provided.

An improved takedown system for slide removal from a firearm is desired.

SUMMARY OF THE DISCLOSURE

A slide takedown system according to some embodiments of the present disclosure includes a takedown mechanism mounted to the pistol which interacts with the slide. The takedown mechanism is manually movable between a blocking position in which removal of the slide from the pistol is prevented and a non-blocking position which enables removal of the slide. In one embodiment, the takedown mechanism includes a lever pivotably mounted to the pistol that is movable into and out of engagement with the slide. The slide takedown system functions in concert with a slide guidance and retention system to prevent or allow removal of the slide from the pistol.

In one embodiment, a firearm with slide takedown mechanism is disclosed including a frame, a barrel supported by the frame and defining a longitudinal axis of the firearm, a trigger movably supported by the frame, a reciprocating slide slidably engaged with the firearm, the slide moveable between a forward position and a rearward removal position, and a takedown lever pivotably mounted to the firearm and engageable with the slide. The takedown lever is pivotable in a lateral direction about the longitudinal axis between a blocking position in which the slide is not movable from the forward position to the rearward removal position and an unblocking position in which the slide is movable to the rearward removal position. When the slide is in the rearward removal position, the slide is configured to be disengageable from the frame for removal. In foregoing or another embodiment, the takedown lever is mounted about a pivot axis oriented parallel to the longitudinal axis of the frame. In the foregoing embodiments, the blocking position of the takedown lever is an upward position proximate to and nested in the frame and the unblocking position is a downward position distal to and spaced away from the frame. Embodiments may include a retaining mechanism for maintaining the takedown lever in the unblocking position.

In another embodiment, a firearm with slide takedown mechanism includes a frame, a barrel supported by the frame and defining a longitudinal axis of the firearm, a trigger movably supported by the frame, and a reciprocating slide supported by the frame for axial movement between a forward position and a rearward removal, position. The slide is configured to be removable from the frame when in the rearward removal position. Also provided is a takedown lever pivotably mounted to the firearm and engageable with the slide, the takedown lever including a mounting end pivotably coupled to the firearm, an opposite free end defining a grasping portion, and a blocking surface interposed between the mounting and free ends. The takedown lever is laterally and downwardly movable between a blocking position in which the blocking surface interposed between the mounting and free ends engages the slide to block movement of the slide from the forward position to the rearward removal position, and an unblocking position in which the blocking surface does not engage the slide and allows movement of the slide from the forward position to the rearward removal position. In the foregoing or other embodiments, the takedown lever is mounted about a pivot pin defining a pivot axis oriented parallel to the longitudinal axis of the frame. In any of the foregoing embodiments, the takedown lever is oriented perpendicular to the longitudinal axis of the firearm.

A method for removing the slide from a firearm is also provided. In one embodiment, the method includes: providing a firearm having a longitudinal axis, barrel with bore, trigger, frame, and a reciprocating slide movable forwards and rearwards on the frame; locating the slide in a forward position; engaging a takedown lever with the slide wherein the slide cannot be moved rearwards past the forward position, the takedown lever being in a blocking position; pivoting the takedown lever outwards from the frame and downwards from the blocking position to an unblocking position; disengaging the takedown lever from the slide; retracting the slide rearwards on the frame to rearward removal position; and removing the slide from the frame. In one embodiment, a rearward facing blocking surface on the slide is moved past a forward facing blocking surface on the takedown lever in retracting the slide to the rearward removal position.

BRIEF DESCRIPTION OF THE DRAWINGS

The features of the exemplary embodiments will be described with reference to the following drawings where like elements are labeled similarly, and in which.

Figure 1:
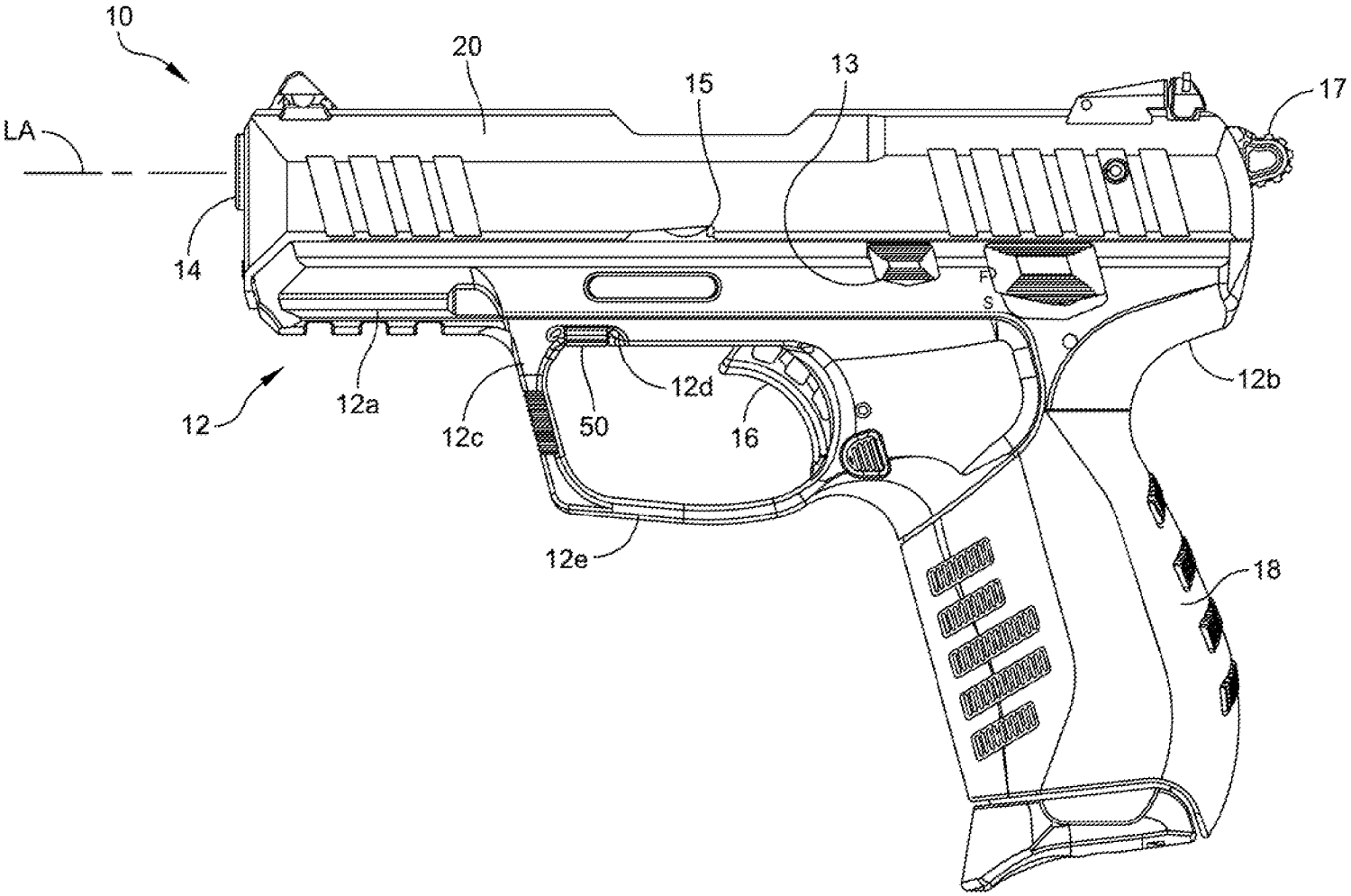
FIG. 1 is a side elevation view of one embodiment of a firearm in the form of a pistol according to the present disclosure having a slide takedown system and showing the slide in a ready-to-fire forward position.

All drawings are schematic and not necessarily to scale.

DESCRIPTION OF EXEMPLARY EMBODIMENTS

The features and benefits of the invention are illustrated and described herein by reference to exemplary embodiments. This description of exemplary embodiments is intended to be read in connection with the accompanying, drawings, which are to be considered part of the entire written description. In the description of embodiments disclosed herein, any reference to direction or orientation is merely intended for convenience of description and is not intended in any way to limit the scope of the present invention. Relative terms such as "lower," "upper," "horizontal," "vertical,", "above," "below," "up," "down," "top" and "bottom" as well as derivative thereof (e.g., "horizontally," "downwardly," "upwardly," etc.) should be construed to refer to the orientation as then described or as shown in the drawing, under discussion. These relative terms are for convenience of description only and do not require that the apparatus be constructed or operated in a particular orientation. Terms such as "attached," "affixed," "connected," and "interconnected," refer to a relationship wherein structures are secured or attached to one another either directly or indirectly through intervening, structures, as well as both movable or rigid attachments or relationships, unless expressly described otherwise. Accordingly, the disclosure expressly should not be limited to such exemplary embodiments illustrating some possible non-limiting combination of features that may exist alone or in other combinations of features.

Figure 2:
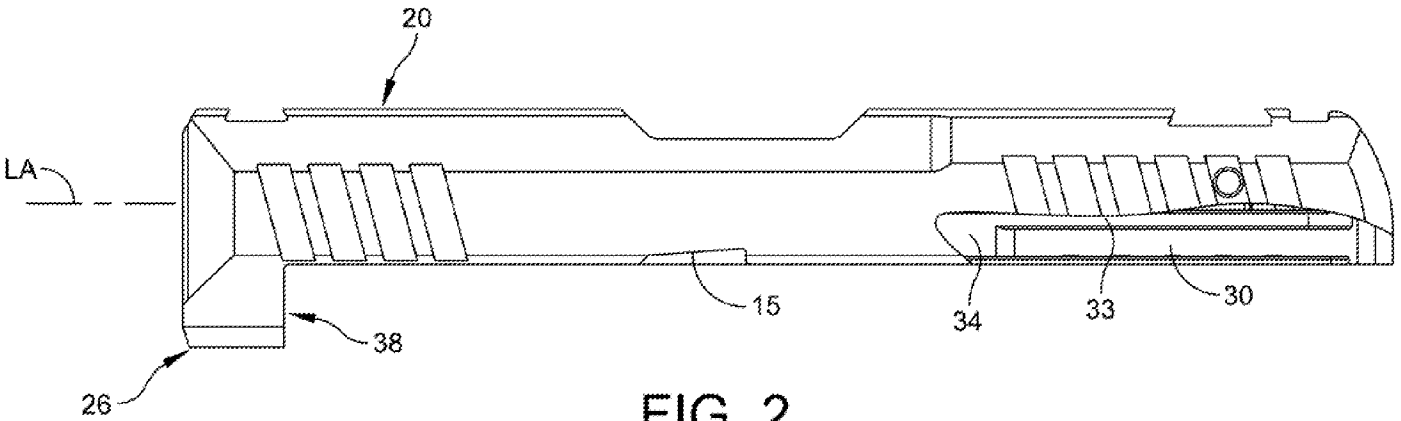
FIG. 2 is a side elevation view of the slide of FIG. 1 with a rear portion of slide cutaway.
Figure 3:
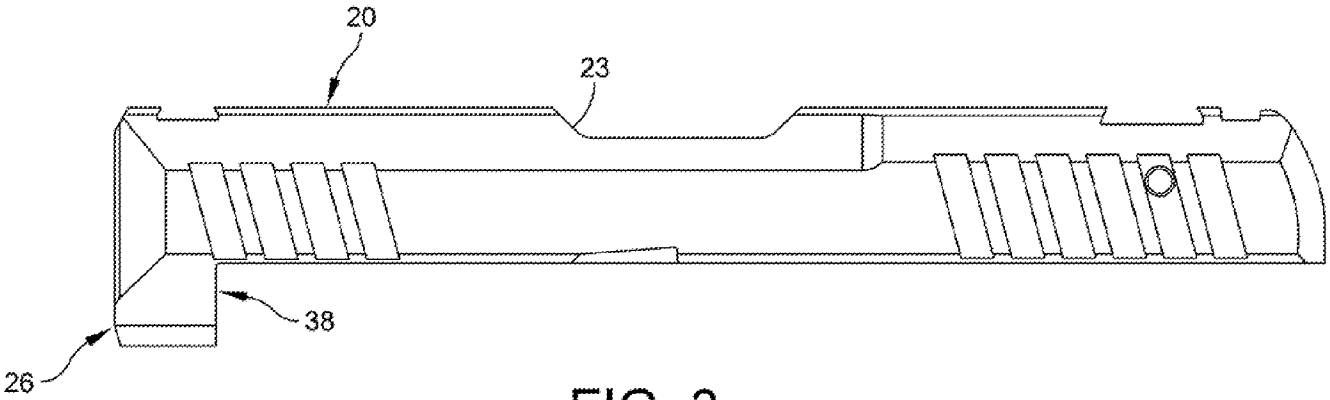
FIG. 3 is a side elevation view thereof.
Figure 6:
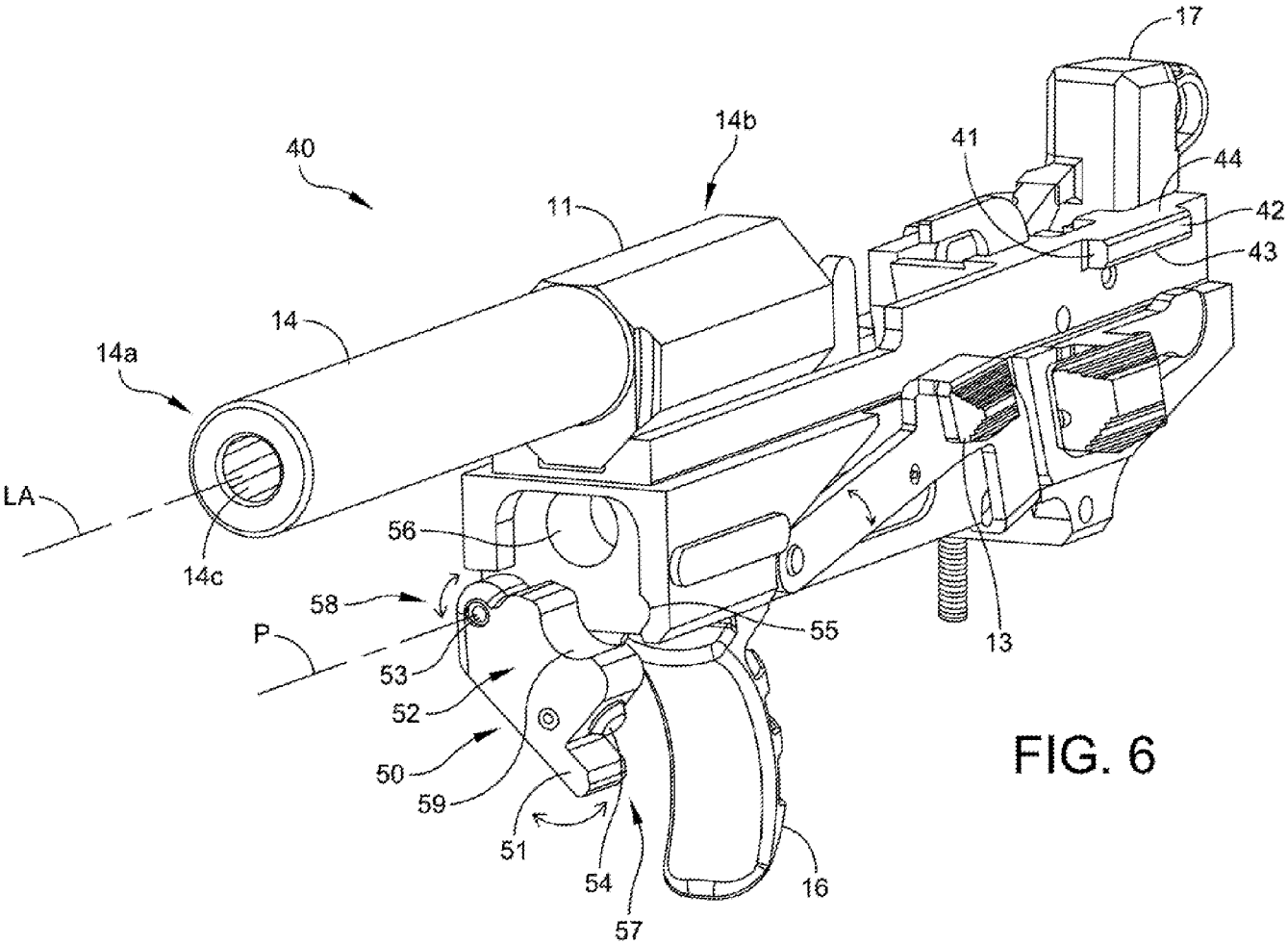
FIG. 6 is a perspective view of a frame insert mounted in the pistol of FIG. 1.

FIG. 1 depicts one embodiment of a semi-automatic pistol 10 having a slide takedown mechanism according to the present disclosure. Referring to FIGS. 1, 2, and 6, pistol 10 defines a longitudinal axis LA and includes a frame 12 having front 12*a*, rear 12*b*, and intermediate 12*c* trigger guard portions, an axially slidable and reciprocating slide 20 mounted on the pistol having a breech block 20*a* (see FIG. 12), a barrel 14 with rifled bore 14*c* and having a front muzzle end 14*a* and a rear end 14*b* defining a chamber 11 (see FIG. 6) configured for holding a cartridge, a hammer 17 pivotably mounted to the pistol, and a trigger 16 pivotably mounted to pistol and operably linked to the hammer via a conventional trigger mechanism for cocking and releasing the hammer to discharge the pistol. In other possible embodiments where pistol 10 may be of a striker-fired design, a striker may be provided in lieu of a hammer. Such striker designs are known to those skilled in the art without further elaboration. In some embodiments, the longitudinal axis LA may be defined by the barrel bore 14*c* (see FIG. 6). The rear portion 12*b* of the frame 12 defines an elongated grip 18 for holding pistol 10. Frame 12 may be made of any suitable material commonly used in the art including metal, polymers, or combinations thereof.

FIG. 6 depicts a frame insert 40 that may be removably mountable in the frame 12. Frame insert 40 is insertable into a longitudinally-extending channel defined in the frame 12. The frame insert 40 may be rigidly and fixedly mounted in the frame 12 via any suitable means known in the art including without limitation mechanical fasteners or pins of any type, adhesives, friction or interference fits, etc. so long as the insert remains stationary with the frame 12 when the pistol 10 is fired. In other possible embodiments, the frame insert 40 may be movably coupled to but retained in frame 12. In some embodiments, the frame insert 40 includes barrel 14 fixedly mounted thereon, trigger 16 pivotably mounted to assembly, and hammer 17 pivotably mounted to the assembly as shown. Frame insert 40 may be made of any suitable material including metal such as for example aluminum, titanium, or steel, or polymers. The barrel 14 and hammer 17 may be made of any suitable material including metals such as steel as commonly used in the art for these components. Frame insert 40 may further include a slide catch 13 which is pivotably mounted on a lever arm to the insert and manually moveable in upward and downward directions. Slide catch 13 interacts and cooperates with a slide catch cutout 15 (see FIG. 1) in a conventional manner to hold the breech area of the pistol open (defined at the rear of the chamber 11).

FIGS. 2-5 show various views of slide 20. Slide 20 is an axially elongated and generally hollow structure defining a longitudinally-extending, internal cavity 20*a*. Slide 20 includes a front end 24, opposing rear end 25, top 21 defining an ejection port 23, and downwardly open bottom 22. Front end 24 includes an enlarged protuberant boss 26 which is vertically elongated and includes a lower lobed portion that projects outward and downward from the main body of the slide 20 as shown. Boss 26 defines an upper barrel hole 27 configured for interacting with and slidably receiving barrel 14 therethrough and a lower guide hole 28 configured for interacting with and slidably receiving a guide rod 19 therethrough (see, e.g. FIGS. 7-10). Holes 27 and 28 extend in an axial direction parallel to longitudinal axis LA. Recoil spring 29 is mounted on guide rod 19 for biasing and returning the slide 20 forward after firing pistol 10 in a conventional manner. In alternate possible embodiments, recoil spring 29 may be mounted concentrically with and surrounding barrel 14 which serves as a guide rod in lieu of providing a separate guide rod 19. Either construction is satisfactory.

Figure 13:
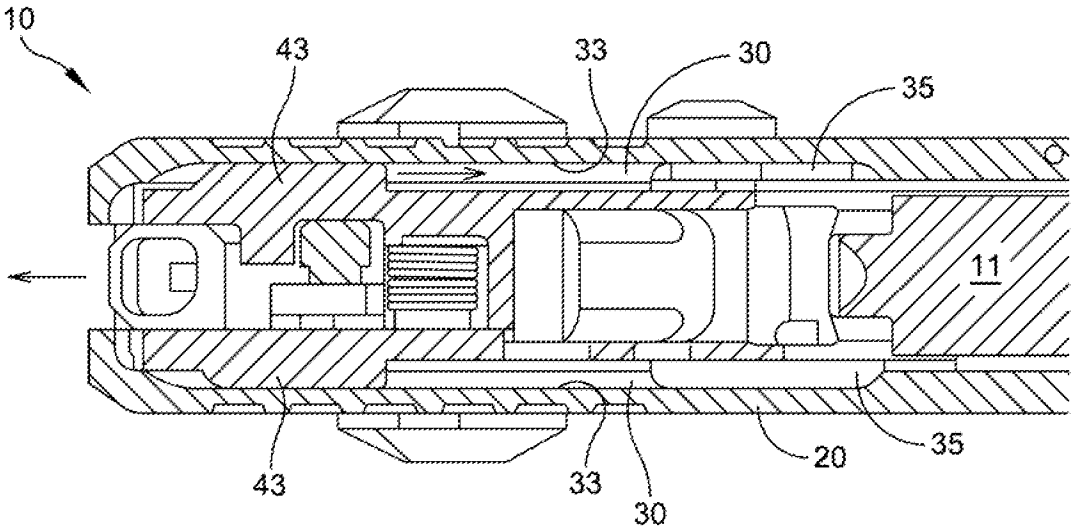
FIG. 13 is a detailed enlarged view of the rear portion of the pistol taken from FIG. 11D.

In one embodiment, reciprocating axial movement of slide 20 on pistol 10 may be guided in part by the enlarged boss 26 on the front portion of the slide (slidably interacting with the barrel 14 and guide rod 19) and at the rear portion of the slide by a mating set of guide rails and guide flanges 30, 43 disposed on the slide and frame insert 40, respectively. In some embodiments, there are two mating sets of guide mils and guide flanges 30, 43 disposed on each lateral side of the slide 20 and frame insert 40 (see, e.g. FIG. 13). The guide rail and flange set define both a slide guidance and retention system that operates in concert with the slide takedown system lever 50 mounted towards the front portion of the slide to either prevent or allow removal of the slide 20 from pistol 10, as further described herein.

Figure 4:
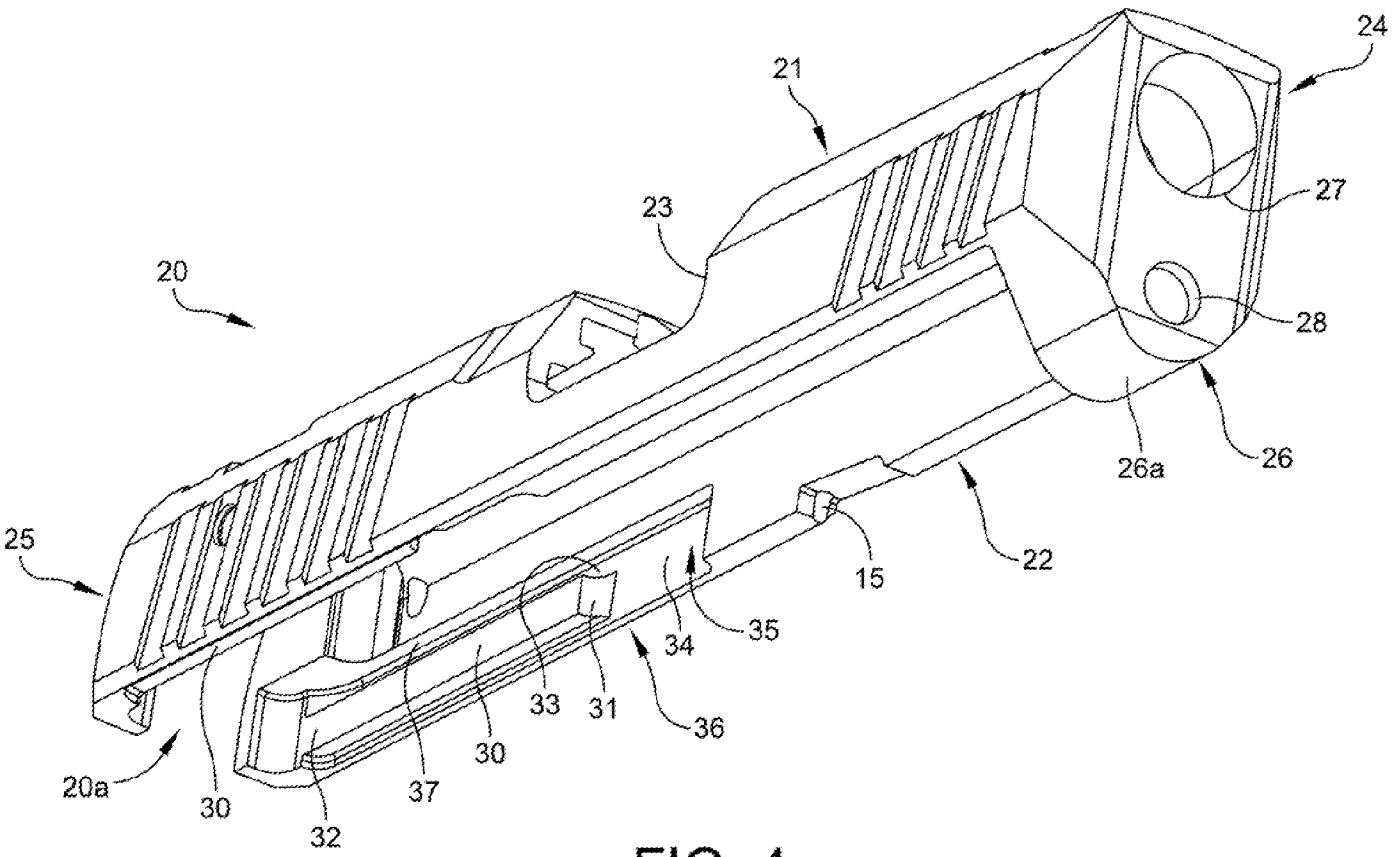
FIG. 4 is a bottom perspective view of the slide looking rearwards.
Figure 5:
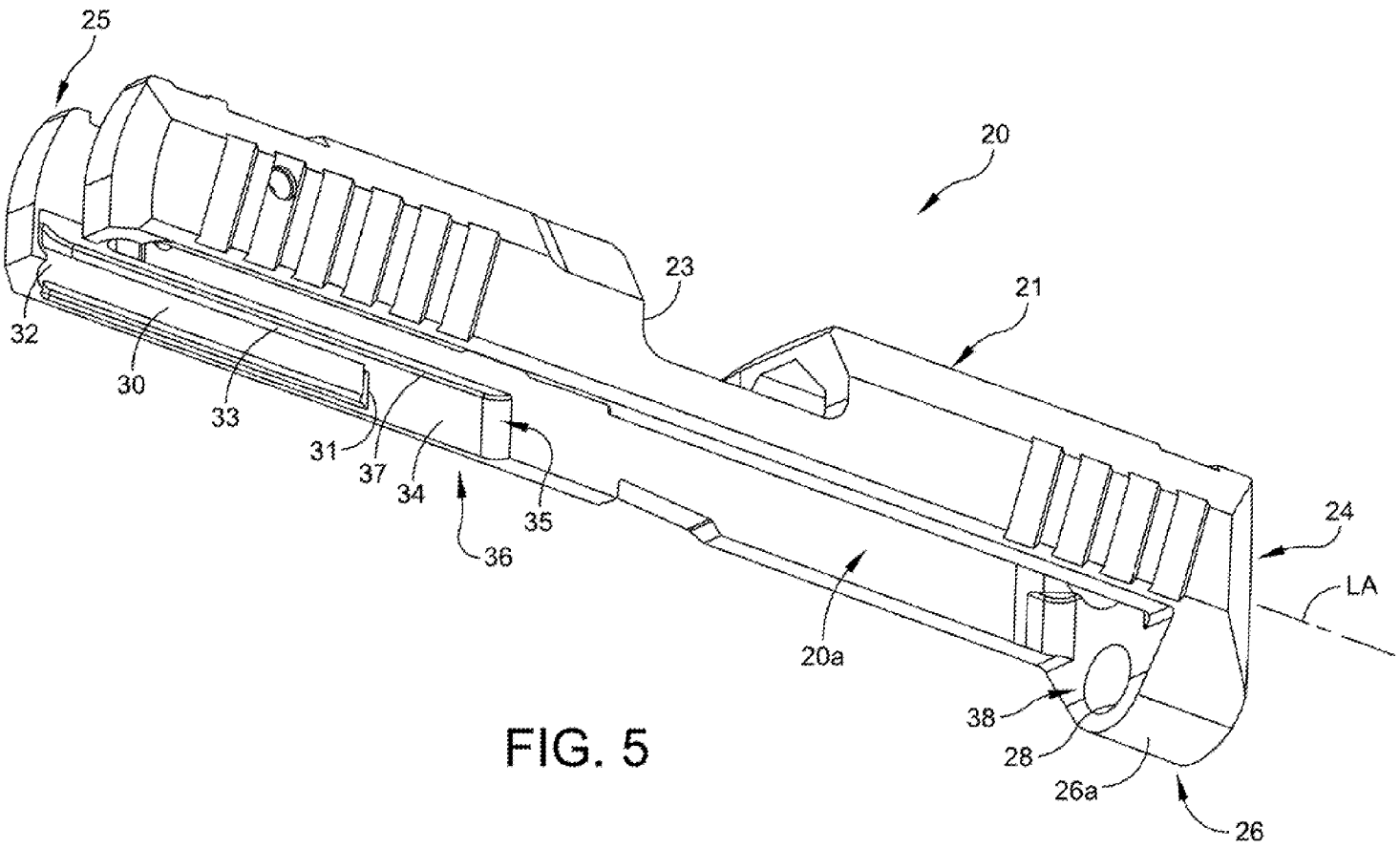
FIG. 5 is a bottom perspective view thereof looking forwards.

Accordingly, referring now to FIGS. 2-5, the slide guidance and retention system in some embodiments includes the slide 20 having a pair of opposing guide rails 30 disposed inside cavity 20*a* which face and extend laterally inwards from the interior surface of the slide towards the longitudinal axis LA. Each rail 30 has a forward end 31 and rear end 32. Rails 30 are axially elongated having a greater length than lateral width or height, as shown in FIG. 5. In some embodiments, guide rails 30 may be formed proximate to the rear end 25 of slide 20 and extend forwardly.

With continuing reference to FIGS. 2-5, disposed adjacent to each guide rail 30 is a recess 35 configured for slidably receiving therein guide flanges 43 formed or disposed on frame insert 40 (best shown in FIGS. 4 and 5). Each recess 35 includes a longitudinally-extending axial guide slot 33 and an enlarged receptacle 34 communicating with and formed at a forward end of the slot, in one embodiment, slot 33 may be disposed above guide rail 30 and receptacle 34 may be disposed forward of a front end 31 of rail 30 as shown. In some embodiments, receptacle 34 may have an axial length that is at least slightly larger than the axial length of guide flange 43 on frame insert 40 to allow the flange 43 to be removably inserted vertically upwards through an open bottom 36 of the receptacle and axially aligned with slot 33 for mounting the slide 20 onto the frame insert 40, and conversely then withdrawn vertically downward through open bottom 36 for removing the slide from the frame for field stripping pistol 10.

Referring to FIG. 6, guide flanges 43 are opposingly positioned on frame insert 40 near a rear portion of the frame insert as shown. Flanges 43 face and extend laterally outwards from the exterior surface of the frame insert 40 away from the longitudinal axis LA. Each flange 43 has a forward end 41 and rear end 42. Flanges 43 are axially elongated having a greater length than lateral width. Flanges 43 are each configured and dimensioned to fit in corresponding slot 33 and receptacle 34 of recess 35. In one embodiment, flanges 43 have an axial length that is shorter than the axial length of guide rails 30 and slots 33 formed in slide 20 (see also FIGS. 11-13).

Referring to FIGS. 2-6, a pair of longitudinally-extending bearing surfaces 37 are defined by the top of each guide slot 33 and receptacle 34 (best shown in FIGS. 4 and 5). When slide 20 is mounted on frame insert 40, the bearing surfaces 37 engage corresponding bearing, surfaces 44 defined on the top of frame insert guide flanges 43 to slidably support slide for reciprocating forward and rearward axial movement between closed and open breech positions, respectively.

Figure 12:
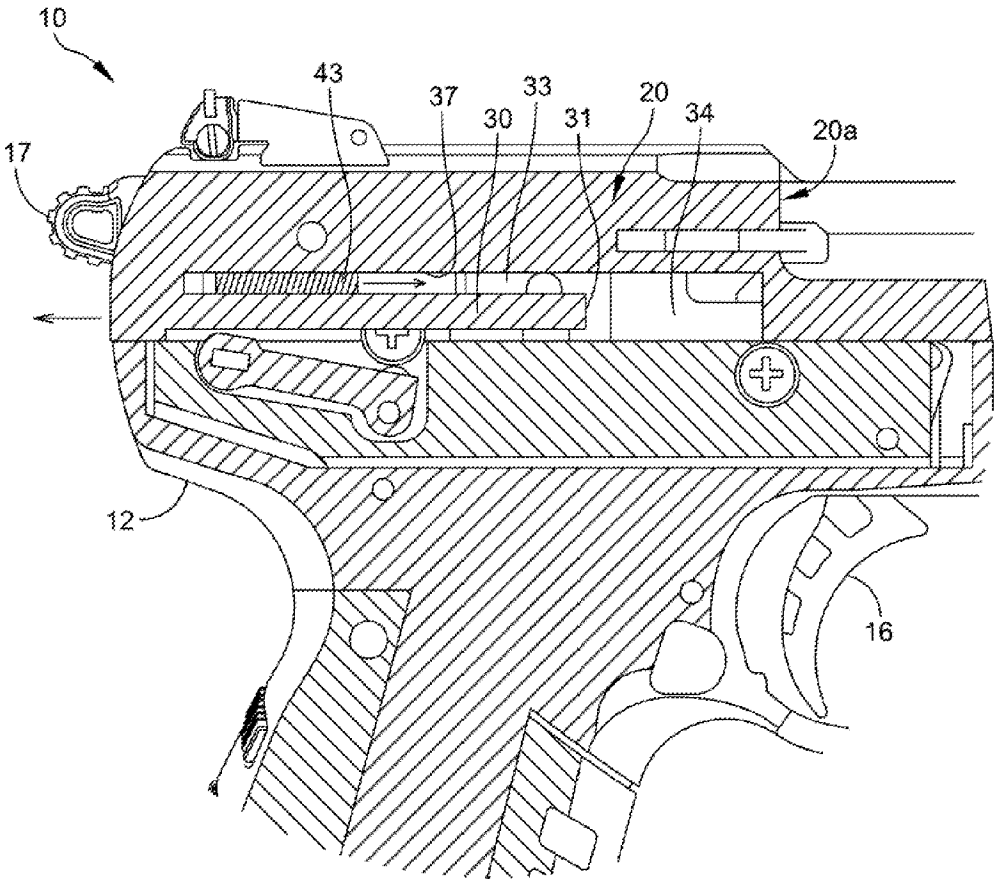
FIG. 12 is a detailed enlarged view of the rear portion of the pistol taken from FIG. 13B.

In some embodiments, as best shown in FIG. 12, sliding of guide flange 43 within elongated slot 33 of slide 20 may be restricted to linear axial motion by making the height of the slot just slightly larger than the height of flange 43. This accommodates the linear motion desired for guiding the reciprocating axial motion of slide 20 on frame insert 40 when cycling the action after discharging pistol 10. Once flange 43 is allowed to fully enter receptacle 34 of slide 20 for field stripping the pistol, movement of flange 43 is largely restricted to vertical motion until the flange exits the open bottom 36 of the receptacle.

During normal firing of pistol 10 and cycling of the action, the slide 20 reciprocates axially between a forward ready-to-fire operating position associated with closed breech (shown in FIG. 1) and a rearward re-loading operating, position associated with an open breech (shown in FIG. 14) for extracting and electing a spent cartridge casing from the pistol. The guide flange 43 on frame insert 40 preferably remains at least partially within the axial slot 33 in the slide 20 when the slide is in the rearward re-loading position to prevent removal of slide from the pistol.

In one embodiment, the slide is further movable in a rearward direction to a second rearward axial removal position for field stripping the pistol. The slide removal position is located farther rearward than the re-loading position of the slide.

To prevent removal of the slide from the pistol 10 during normal pistol operation, a takedown mechanism is provided according, to embodiments of the present disclosure which operates to restrict the maximum rearward movement of the slide 20 to the first rearward re-loading position described herein that is associated with normal cycling of the action. Accordingly, when activated, the takedown mechanism prevents rearward movement of slide 20 to the second rearward removal position. In some embodiments, the takedown mechanism may be a takedown lever 50 that may be pivotably mounted to pistol 10 as shown in FIGS. 6-10. In one embodiment, takedown lever 50 may be pivotably mounted to frame 12, and in a certain embodiment to frame insert 40 as shown in FIG. 6. The takedown lever and operation thereof will now be described in further detail.

Referring first FIGS. 6-10, takedown lever 50 may be mounted to a front portion of frame insert 40 as shown via a pivot pin 53, or alternatively pin 53 may be mounted directly to frame 12. In one embodiment, takedown lever 50 is located below slide 20 underneath and on the underside of frame 12 within a recess 12*d* (see, e.g. FIG. 7), and in one certain embodiment generally within the confines of the trigger guard portion 12*c* and trigger guard 12*e* of the frame as shown in FIG. 1. Pivot pin 53 defines a pivot axis P and may be axially oriented in the direction of longitudinal axis LA (i.e. parallel to the longitudinal axis) so that takedown lever 50 pivots in a lateral direction upward and downward transversely or perpendicular to longitudinal axis LA as best shown in FIG. 6. Accordingly, takedown lever 50 pivots within a vertical and laterally-oriented plane that is perpendicular to and intersects longitudinal axis LA. Pivot pin 53 may be laterally offset from longitudinal axis LA and centerline of pistol 10 as shown in FIG. 6 being mounted closer to one lateral side of frame insert 40 than the other lateral side. Takedown lever 50 is movable between an upward blocking position proximate to frame 12 and a downward unblocking (non-blocking) position distal to frame 12.

Figure 7:
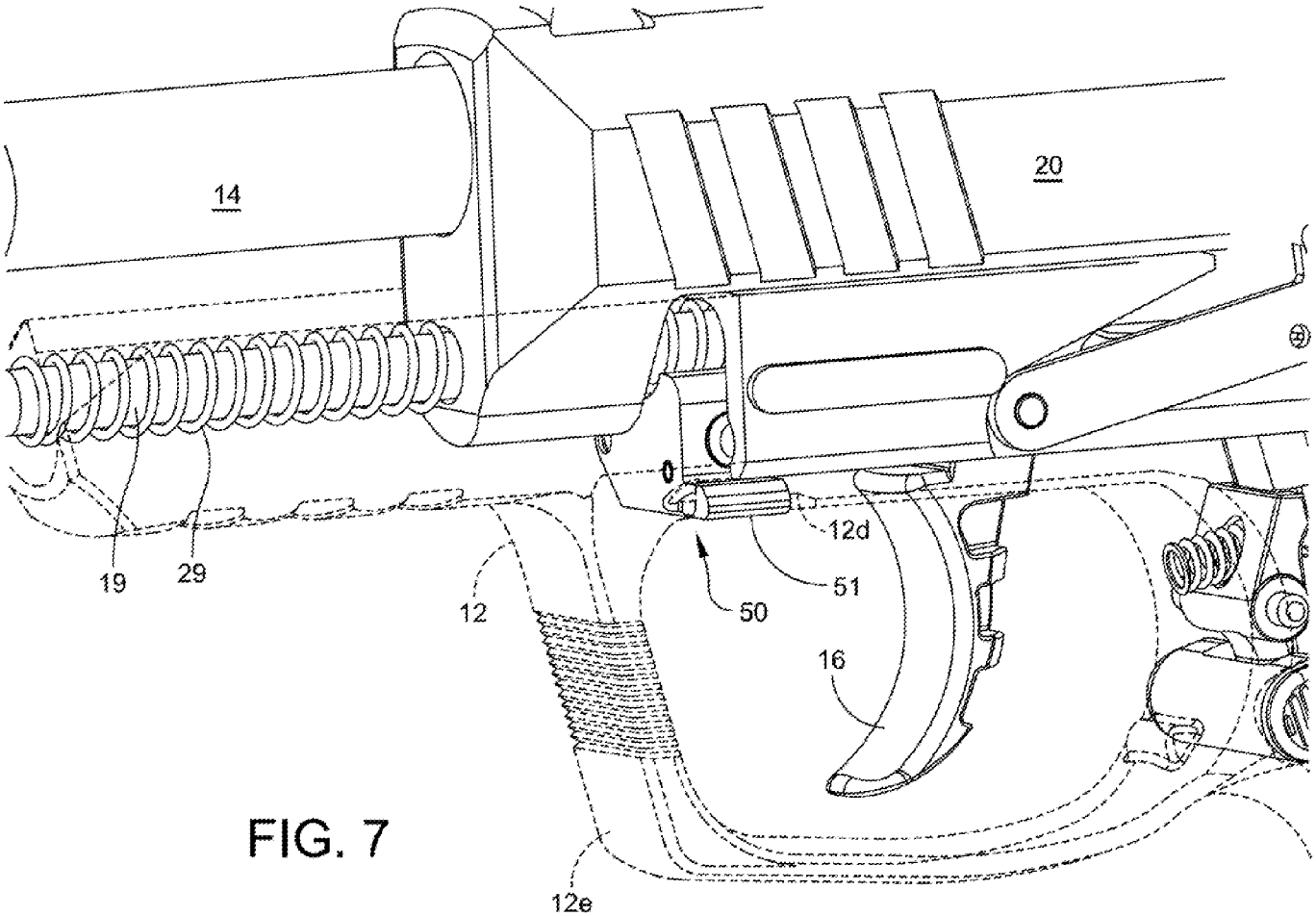
FIG. 7 is a perspective view of a portion of the pistol of FIG. 1 showing the slide takedown system lever in the inactivated upward blocking position.
Figure 8:
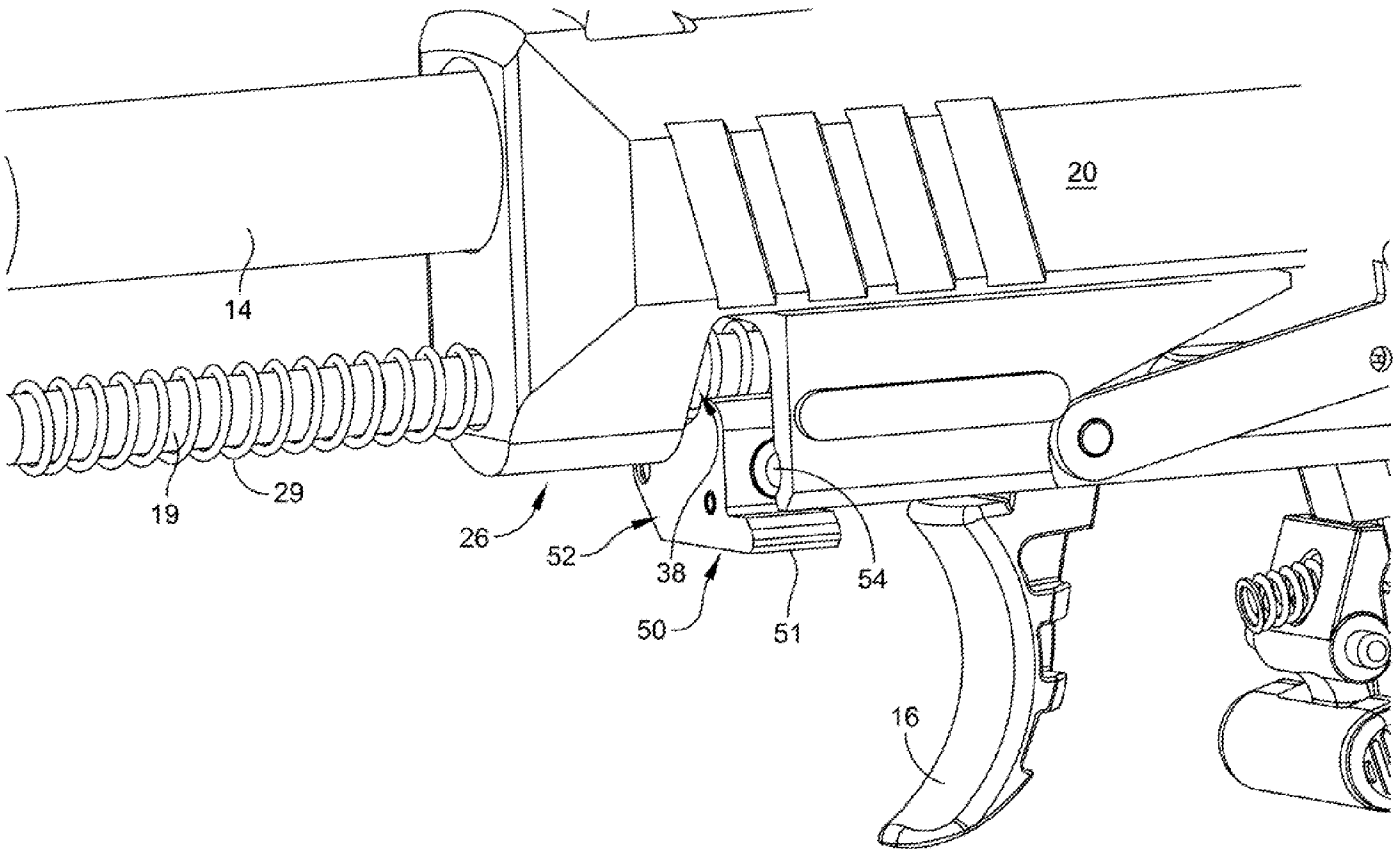
FIG. 8 is the same view thereof with the frame removed for clarity to better show the slide takedown system lever.

When takedown lever 50 is in the blocking position shown in FIGS. 7 and 8, slide 20 cannot be removed from frame insert 40 and pistol 10. The maximum rearward movement of the slide is limited to the first rearward re-loading position. The slide can be moved to the re-loading position either manually or automatically upon firing the pistol and cycling the action.

Figure 9:
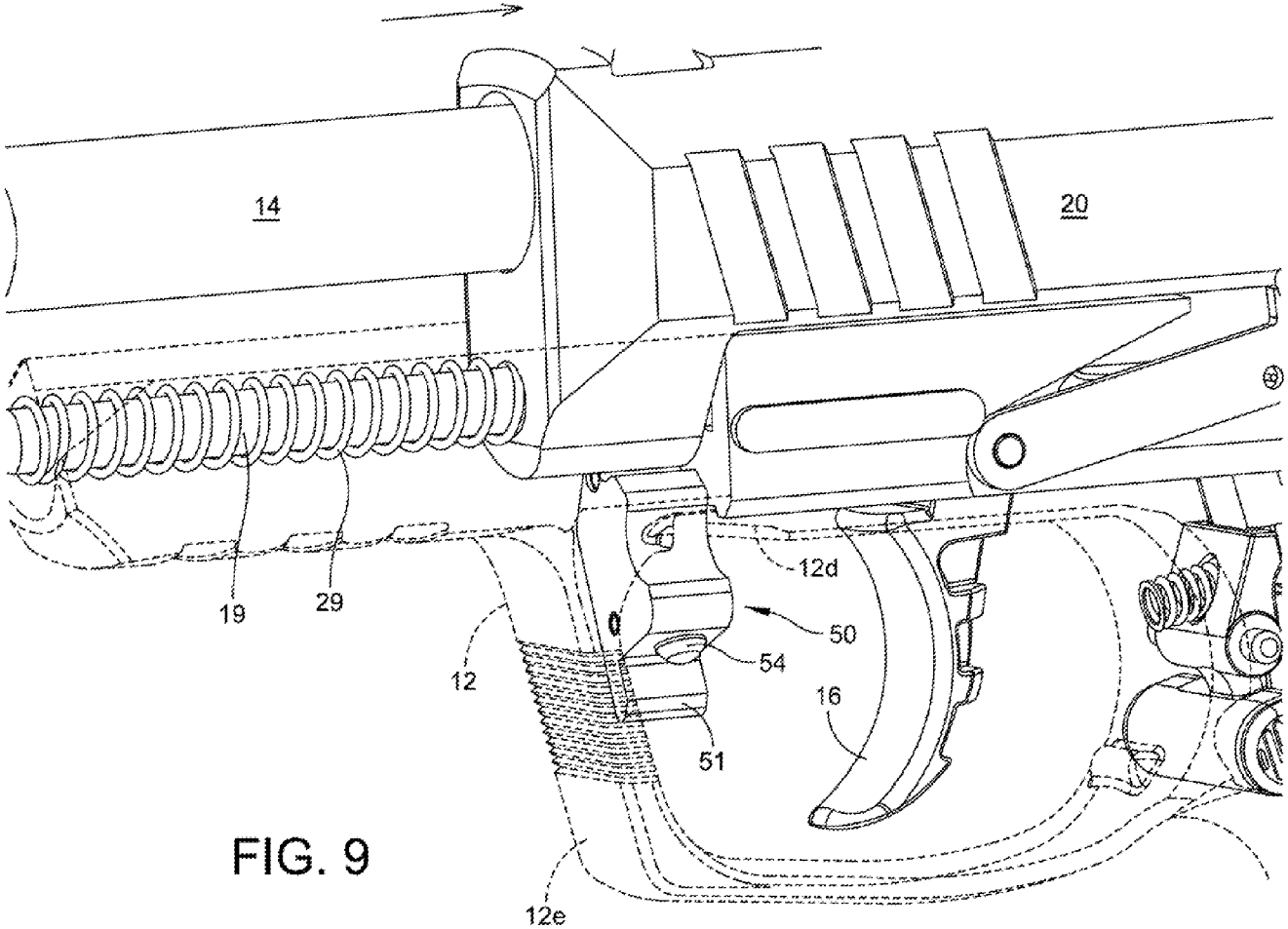
FIG. 9 is a perspective view of a portion of the pistol of FIG. 1 showing the slide takedown system lever in the activated downward unblocking position.
Figure 10:
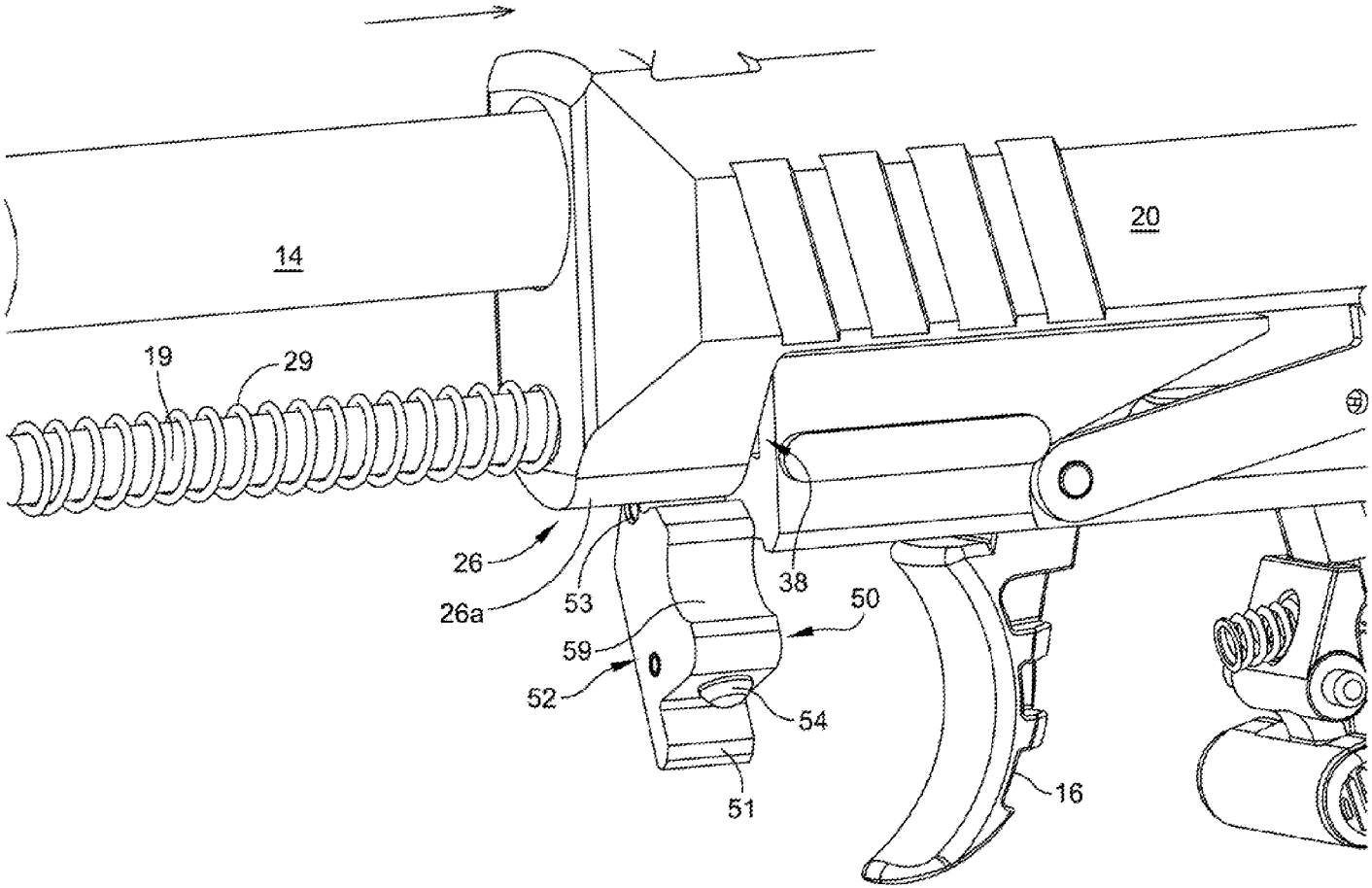
FIG. 10 is the same view thereof with the frame removed for clarity to better show the slide takedown system lever.
Figure 11C:
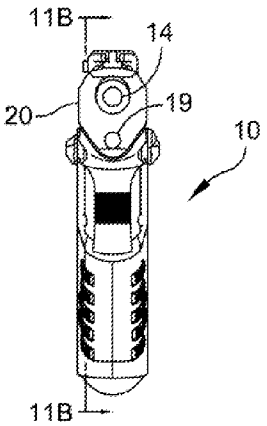
FIG. 11C is a front elevation view of the pistol of FIG. 1.
Figure 11B:
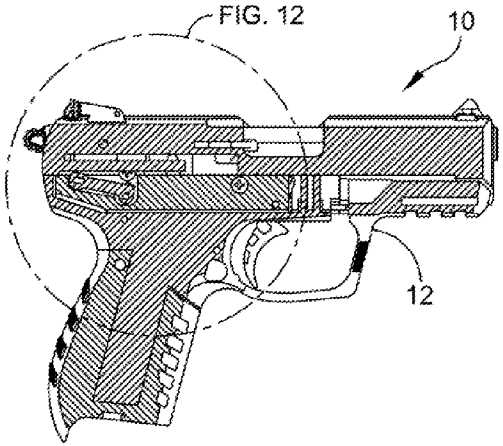
FIG. 11B is a longitudinal cross-sectional side elevation view of the pistol of FIG. 1.
Figure 11A:
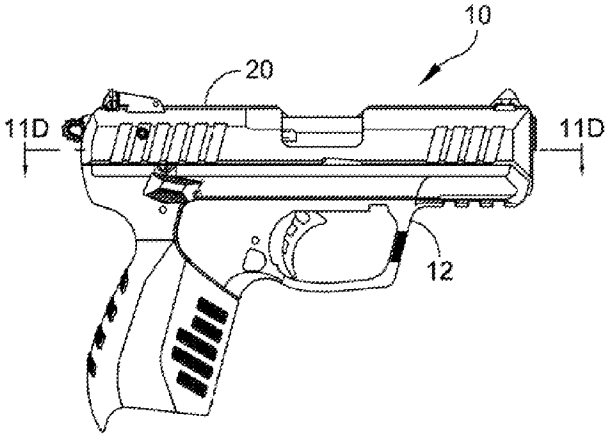
FIG. 11A is another side elevation view of the pistol of FIG. 1.
Figure 11D:
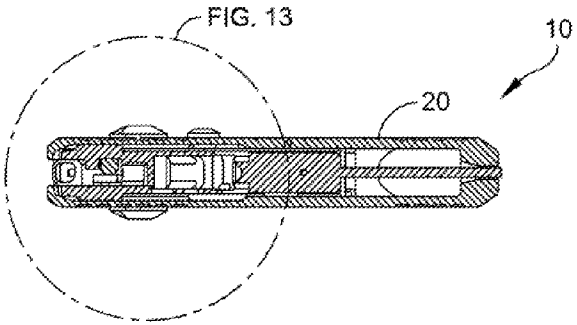
FIG. 11D is a longitudinal cross-sectional top view of the pistol of FIG. 1 taken along Line 11D-11D in FIG. 11A.

When takedown lever 50 is in the unblocking position shown in FIGS. 9 and 10, the slide 20 can be manually moved by a distance to the second rearward slide removal position. In this position, slide 20 is fully removable from the pistol 10 and frame insert 40.

Figure 16B:
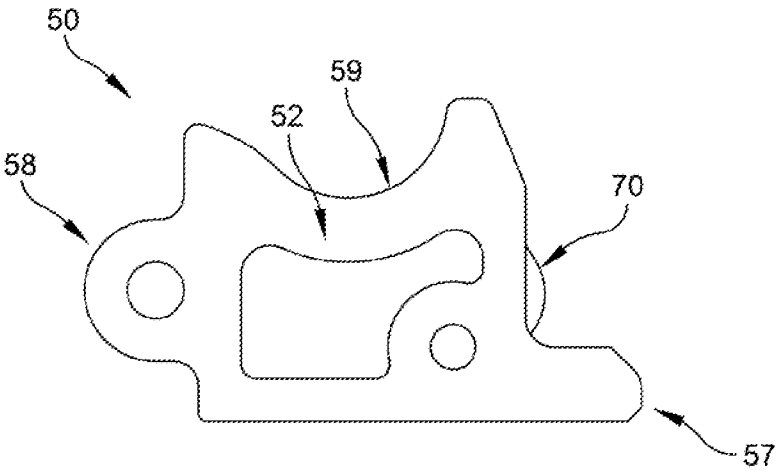
FIG. 16B is a side elevation view thereof.
Figure 16A:
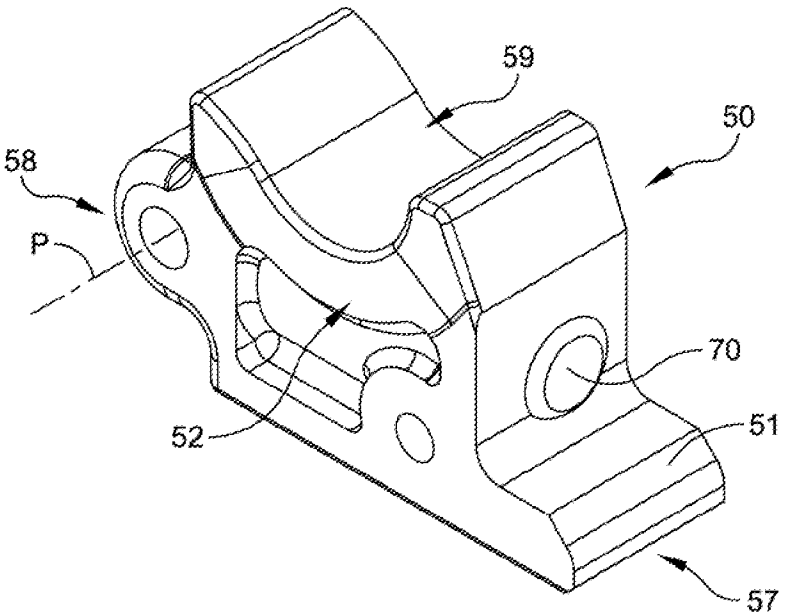
FIG. 16A is a perspective view of the slide takedown lever showing an alternative embodiment of a retaining mechanism for maintaining lever in an upward unblocking position.

Referring to FIGS. 6-10, in some embodiments, takedown lever 50 may be maintained in the upward blocking position via retaining mechanism such as without limitation a spring loaded detent plunger 54 which engages a complementary configured detent recess 55 disposed in frame 12 either in frame insert 40 as shown in FIG. 6 or alternatively directly in frame 12. In other embodiments, the detent plunger may alternatively be disposed in the frame 12 or frame insert 40 and the recess may be disposed in takedown lever 50. Other suitable retaining mechanisms may be used to maintain lever 50 in the upward unblocking position, including without limitation a flexible or resilient cantilevered portion or protrusion formed as an integral unitary part of the lever or frame 12 that is configured to engage a complementary mating recess 55. One such non-limiting example of such an embodiment is shown for in FIGS. 16A-B which includes a protrusion 70 formed as an integral part of takedown lever 50 such that there is no relative movement between the protrusion and lever.

Figure 17:
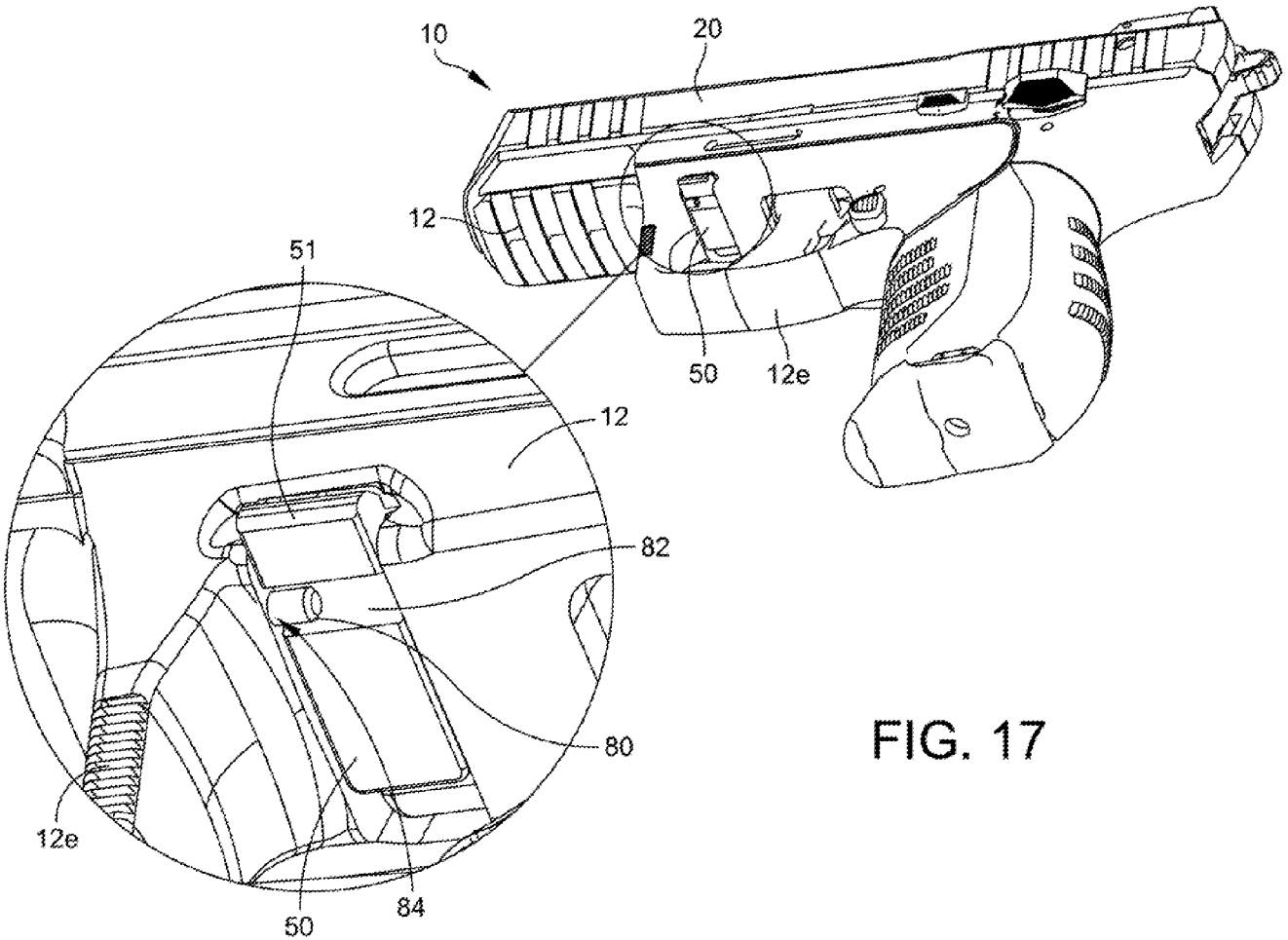
FIG. 17 is a perspective view of the pistol of FIG. 1 showing another alternative embodiment of a retaining mechanism for maintaining lever in an upward unblocking position.

FIG. 17 shows another alternative embodiment of a retaining mechanism for maintaining lever 50 in the upward unblocking position. The underside of takedown lever 50 is provided with an axially extending retaining groove 82 that receives an axially extending moveable retaining pin 80 projecting in a rearward direction from frame 12. Retaining pin 80 is moveable in an axial direction and may be disposed in a corresponding hole 84 in frame 12 configured to receive the pin. In one embodiment, retaining pin 80 may be spring-biased rearward into a retaining position as shown and can be pushed forward back into the hole 84 in a non-retaining position wherein the takedown lever can be pivoted downwards in the manner already described herein to remove the slide 20 from pistol 10. Alternatively, a latch or similar mechanical member could alternatively be provided to achieve the same functionality as retaining pin 80.

Figure 18:
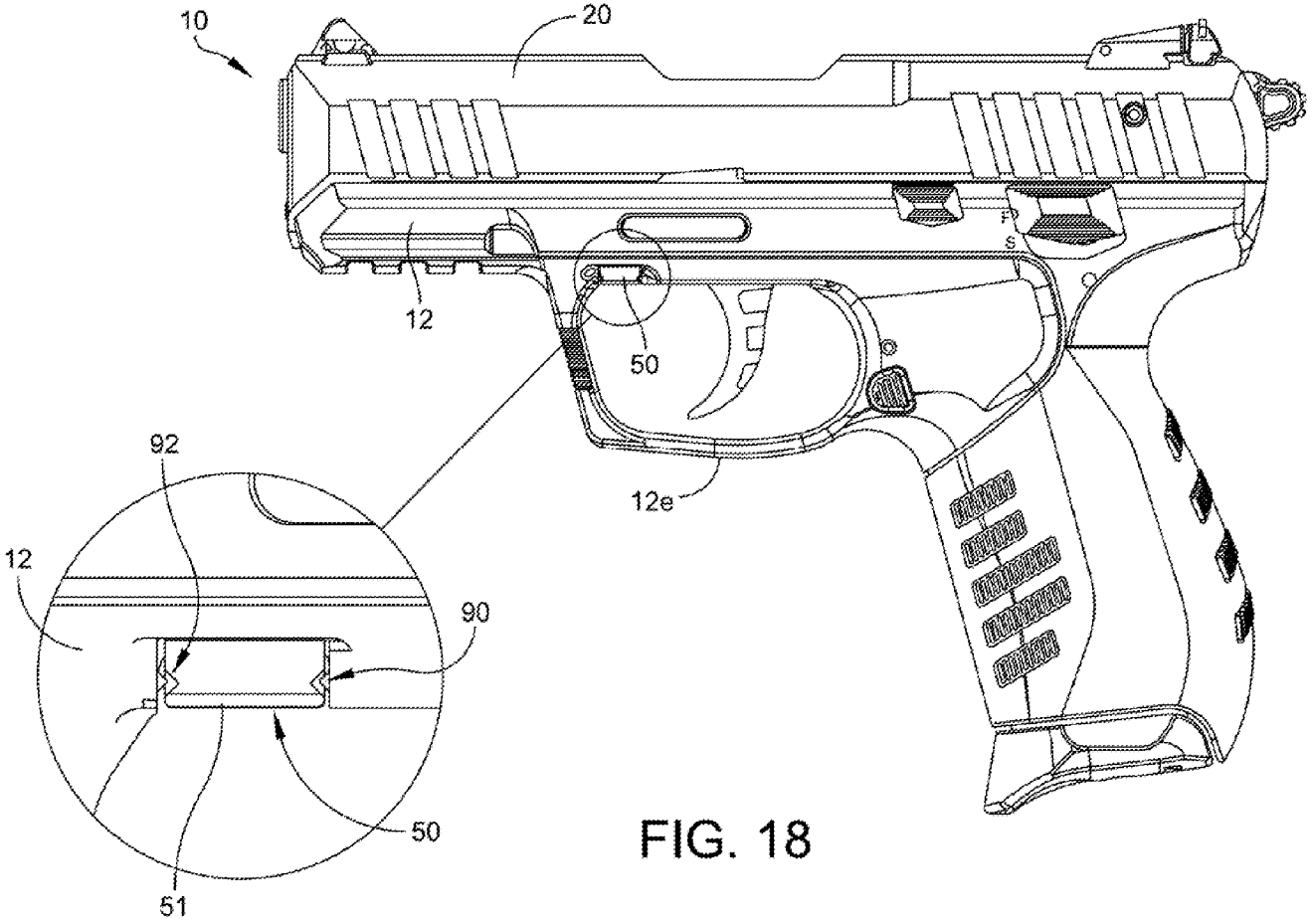
FIG. 18 is a side elevation view of the pistol of FIG. 1 showing yet another alternative embodiment of a retaining mechanism for maintaining lever in an upward unblocking position.

FIG. 18 shows yet another alternative embodiment of a retaining mechanism for maintaining lever 50 in the upward unblocking position, in this embodiment, the front and/or rear surfaces of takedown lever 50 include transverse-oriented recesses 92 configured to receive complementary configured mating transverse-oriented raised protrusions 90 disposed on frame 12. In one embodiment, the recesses 92 may be transversely elongated in the form of slots and the protrusions 90 may be transversely elongated in the form of raised ridges that removably engage the slots. In other embodiments, the takedown lever 50 may alternatively have protrusions 90 and the frame 12 may have recesses 92.

To facilitate manually operating the takedown lever, some embodiments of takedown lever 50 may further include a cantilevered grasping portion 51 formed on a free end 57 of the lever opposite the mounting end 58 of the lever at pivot pin 53. The grasping portion 51 may seat substantially flush with the underside of frame 12 nested in recess 12*d* within the trigger guard 12*e* when takedown lever 50 is in the blocking position as shown in FIG. 1 to prevent interfering with the shooter's trigger finger. Accordingly, this placement and nesting locates the grasping portion 51 in an unobtrusive position when not deployed and replaces some conventional arrangements having takedown pins or lever cantilevered from the sides of slide that adds to the number of exposed levers and profile of the pistol, and further creates the possibility of snagging the pistol on the user's clothing or other object.

Slide takedown lever 50 includes blocking surface 52 formed on a front face of the takedown lever 50 as shown in FIG. 6, which is interposed between grasping, portion 51 on free end 57 of the lever and the mounting end 58 of the lever at pivot pin 53. In one embodiment, the intermediate portion of takedown lever 50 defining blocking surface 52 may be physically enlarged in relation to the grasping portion 53 thereby providing a structurally robust element. Since blocking surface 52 in the present embodiment also serves to abuttingly arrest the rearward travel of slide 20 under recoil after discharging pistol 10 by engaging, a mating blocking surface 36 on the rear of enlarged boss 26 (see, e.g. FIG. 8 showing an open breech position for ejecting a spent cartridge), the added structural strength helps to better absorb and distribute the recoil forces. Accordingly, in some embodiments, the material selected for takedown lever 50 preferably may be an impact resistant and energy absorbing material.

Slide takedown lever 50 may be made of any suitable material, including without limitation metals (e.g. steel, aluminum, titanium and alloys thereof) or polymers.

An exemplary method of operating takedown lever 50 will now be described. FIGS. 7-10 depict a forward portion of pistol. 10 with and without frame 12 in place for clarity.

Figure 14:
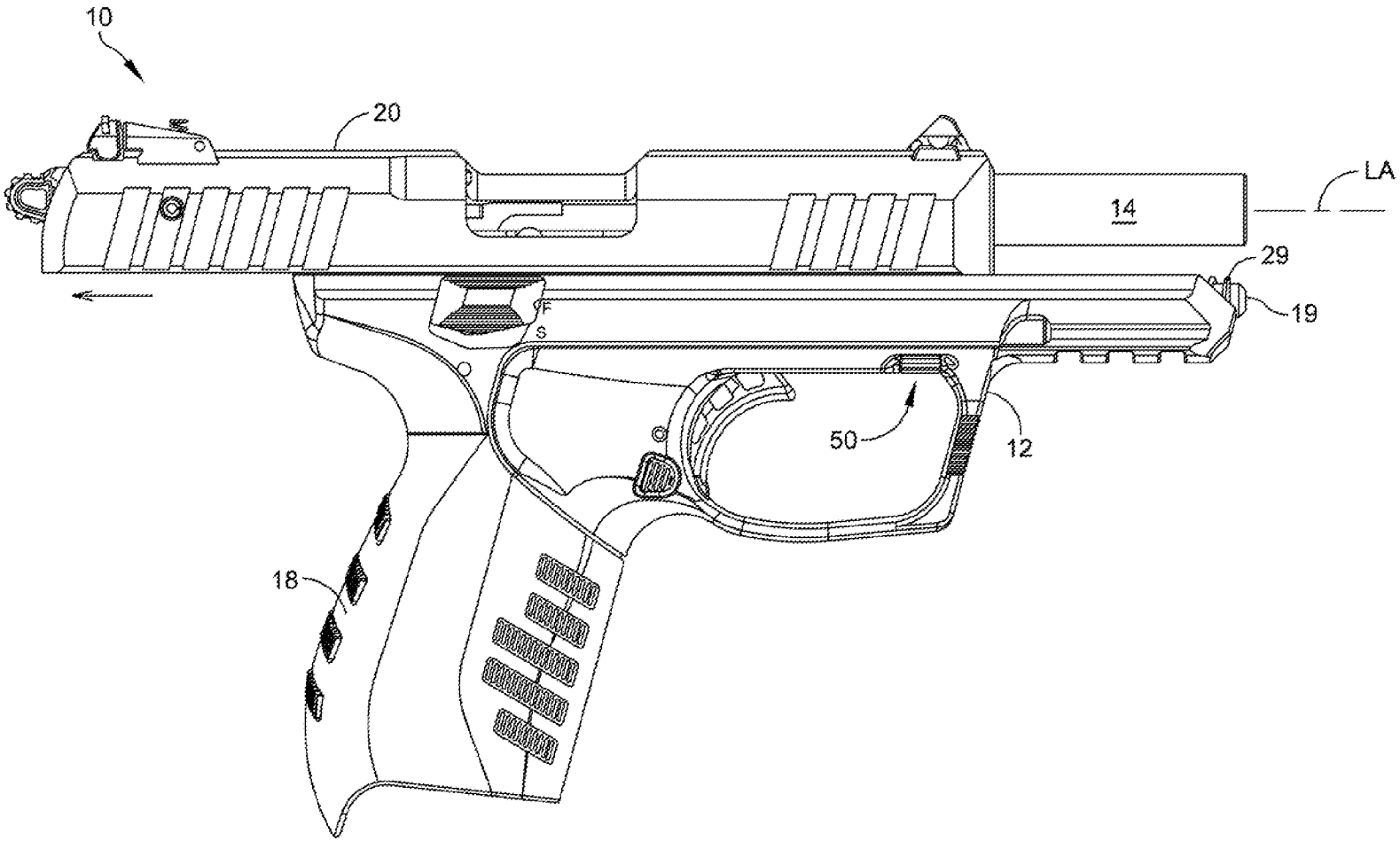
FIG. 14 is a side elevation view of the pistol of FIG. 1 with the slide in the retracted rearward re-loading position.

Referring initially to FIGS. 7 and 8, the slide 20 is shown in the first rearward re-loading operating position being already moved rearwards from a forward ready-to-fire position shown in FIG. 1 either by manually retracting the slide or being held in rearward re-loading position after firing a last round (see also FIG. 14). The barrel 14 and guide rod 19 are shown exposed and protruding forward from enlarged boss 26. The breech area to the rear of chamber 11 would be in the open condition to allow for extraction of a spent cartridge casing from the chamber and ejection from the pistol. These foregoing operating positions and methodology are conventional and well known to those skilled in the art.

With continuing reference to FIGS. 7 and 8, takedown lever 50 is shown in the upward blocking position. When either the trigger 16 is pulled and the action is cycled upon discharging the pistol, or if a user manually retracts the slide, the slide will move rearward by an axial distance until a blocking surface 52 formed on a front face of the takedown lever 50 abuttingly engages a mating blocking surface 38 defined on a rear face of the enlarged protuberant boss 26 on the front end 24 of the slide. Blocking surfaces 38 and 52, which may comprise at least a portion of takedown lever 50 and enlarged boss 26, are substantially planar in one embodiment, in this position, the guide flanges 43 on frame insert 40 remain at least partially trapped within axial slot 33 in slide 20 so that the flanges cannot fully enter the receptacle 34 to a point that would allow the slide to be lifted vertically upward and off of the frame insert (see also FIGS. 4 and 5). The slide 20 and frame insert. 40 are therefore still interlocked so that the slide cannot be moved vertically. If an attempt were made to lift the slide off the frame insert without the flanges being completely in the receptacle 34, the top of the front end 31 portion of guide rails 30 would catch on the bottom of the rear end 42 portion of the guide flanges 43 thereby preventing removal of the slide. The takedown lever 50 therefore blocks the rearward path of travel of the slide 20 and prevents the slide 20 from moving rearward far enough from the first rearward re-loading position to the second rearward removal position that would permit complete removal of the slide from the pistol 10.

To remove the slide 20 from pistol 10, the takedown lever 50 is first manually moved by a user to the downward unblocking position shown in FIGS. 6 and 9-10. The takedown lever 50 is pivoted in an arcuate path about the longitudinal axis and laterally to reach the unblocking position since the pivot pin 53 is oriented parallel to the longitudinal axis. The takedown lever 50 is no longer engaged with or blocking the rearward path of travel of the slide 20. With the takedown lever 50 out of the way, the slide may now be moved manually rearward by a greater axial distance until the blocking surface 38 defined on a rear face of the enlarged boss 26 abuts or is proximate to the front of the main body portion of the frame insert 40 as shown in FIGS. 9-10. The takedown lever 50 is preferably configured and dimensioned so that the lower lobed portion of the front enlarged slide boss 26 is not obstructed and impeded by the lever when moving the slide to the rearward removal position. The enlarged boss 26 moves at least partially over top of and is positioned above the slide takedown lever 50 as shown in FIGS. 9 and 10. In one embodiment, takedown lever 50 has a concave top surface 59 that is configured to complement a downwardly convex bottom surface 26*a* of enlarged boss 26 (see also FIGS. 4 and 5) to allow the enlarged boss pass at least partially over takedown lever to reach the rearward slide removal position.

With the slide 20 now in the position shown in FIGS. 9 and 10, the slide may be removed from the pistol 10. The guide flanges 43 on frame insert 40 have left the axial slot 33 in slide 20 and have now fully entered the receptacle 34 to a position that would allow the slide to be lifted vertically upward and off of the frame insert (see also FIGS. 4 and 5). The slide 20 and frame insert 40 are no longer interlocked. The front end 31 of guide rails 30 are now positioned completely rearward and clear of the rear end 42 of the guide flanges 43 thereby allowing removal of the slide.

To complete removal of the slide 20 and field, stripping, the rear end 25 of the slide 20 may next be tilted upwards and lifted vertically off of the frame insert 40. The guide flanges 43 on frame insert 40 will leave the receptacles 35 in slide 20 through the bottom opening 36 (see, e.g. FIG. 4). The user would next move the slide forward until the front of the barrel 14 and front of the guide rod 19 emerge rearward from their respective holes 27, 28 in enlarged boss 26, thereby freeing the slide completely. The rear end of the guide rod 19 remains inserted in hole 56 formed in frame insert 40 (see FIG. 6).

The slide 20 may be re-installed on pistol 10 by reversing the foregoing steps.

Figure 15A:
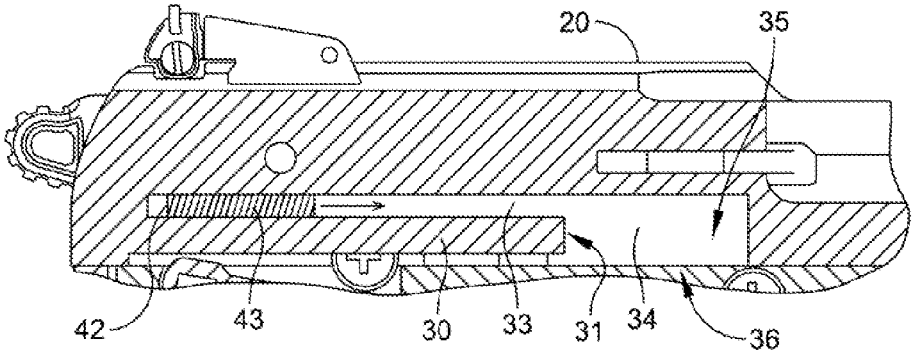
FIGS. 15A-C are enlarged cross-sectional views of a rear portion of the slide with a rail and flange slide retention system in various operating positions.
Figure 15B:
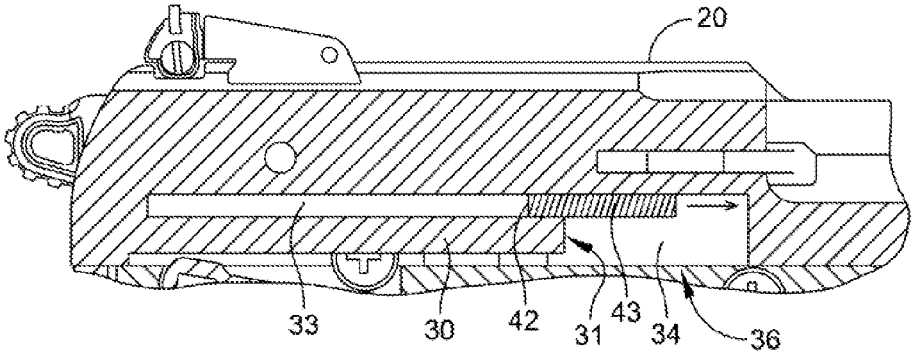
Figure 15C:
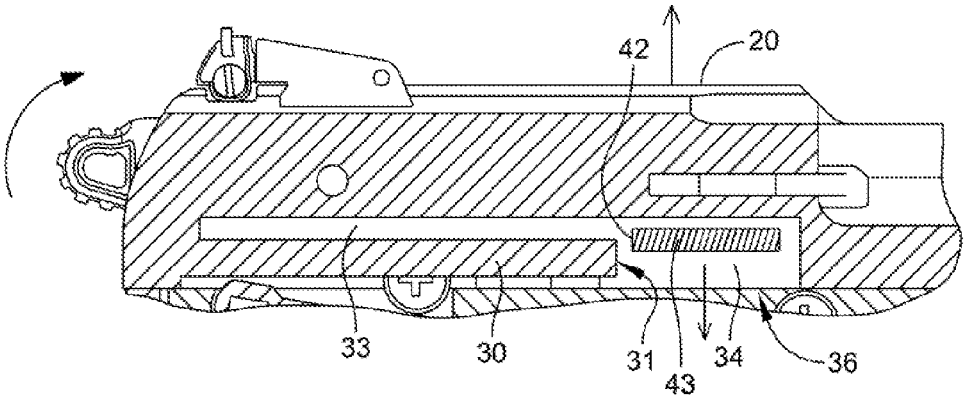

FIG. 15A-C shows the slide 20 and positions of guide flange 43 on frame insert 40 in relation to recess 35 (including guide slot 33 and receptacle 34) and guide rails 30 formed in the slide in the various operating positions of the slide described herein. FIG. 15A shows guide flange 43 in a rear portion of guide slot 33 when slide 20 is in the ready-to-fire fully forward position (see also FIG. 1). The takedown lever 50 is in the blocking position shown in FIGS. 7 and 8. FIG. 15B shows flange 43 in a partial forward position when slide 20 in the first rearward re-loading position (see also FIG. 14). At least part of flange 43 remains in guide slot 33. The rear end 42 of flange 43 is not clear of and obstructed from vertical movement by interference from the front end 31 of guide rail 30 as shown. The takedown lever 50 would still be in the upward blocking position shown in FIGS. 7 and 8. FIG. 15C shows guide flange 43 in the fully forward position and located completely within receptacle 34. The slide 20 is in the second rearward removal position. The takedown lever 50 would be in the downward unblocking position shown in FIGS. 9 and 10 to allow the slide to reach this more distant removal position as described herein. The guide flange 43 may now exit the receptacle 34 through bottom opening 36 when the slide is lifted to allow the slide to be removed from the pistol 10.

It should be noted that the frame insert 40 and guide flange 43 shown in FIGS. 15A-C actually remain stationary with the pistol frame 12 between the various positions shown for the slide 20. The slide 20 is the moveable component and the axial position of the slide 20 with respect to the frame 12 and frame insert 40 is actually changing which is what is intended to be depicted in these figures.

Advantages of the slide takedown lever system disclosed herein include a convenient and easy to deploy lever which is not obtrusive and does not require excessive manipulation or removal of pin, etc. from the pistol which may be lost. Placement of the lever on the underside of the frame and within the trigger guard reduces the likelihood that the takedown lever will be inadvertently actuated or snag on a user's clothing or other object.

While the foregoing description and drawings represent exemplary embodiments of the present disclosure, it will be understood that various additions, modifications and substitutions may be made therein without departing from the spirit and scope and range of equivalents of the accompanying claims. In particular, it will be clear to those skilled in the art that the present invention may be embodied in other forms, structures, arrangements, proportions, sizes, and with other elements, materials, and components, without departing from the spirit or essential characteristics thereof. In addition, numerous variations in the methods/processes. One skilled in the art will further appreciate that the embodiments may be used with many modifications of structure, arrangement, proportions, sizes, materials, and components and otherwise, used in the practice of the disclosure, which are particularly adapted to specific environments and operative requirements without departing from the principles described herein. The presently disclosed embodiments are therefore to be considered in all respects as illustrative and not restrictive. The appended claims should be construed broadly, to include other variants and embodiments of the disclosure, which may be made by those skilled in the art without departing from the scope and range of equivalents.

What is claimed:

1. A firearm with slide takedown mechanism comprising:

a frame;

a barrel supported by the frame and defining a longitudinal axis of the firearm;

a trigger movably supported by the frame;

a reciprocating slide slidably engaged with the firearm, the slide moveable between a forward position and a rearward removal position; and a takedown lever pivotably mounted to the firearm and engageable with the slide, the lever being pivotable in a lateral direction about the longitudinal axis between a blocking position in which the slide is not movable from the forward position to the rearward removal position and an unblocking position in which the slide is movable to the rearward removal position;

wherein when the slide is in the rearward removal position, the slide is configured to be disengageable from the frame for removal;

wherein the takedown lever is mounted about a pivot axis oriented parallel to the longitudinal axis of the frame.

2. The firearm of claim 1, wherein the blocking position of the takedown lever is an upward position proximate to the frame and the unblocking position is a downward position distal to the frame.

3. The firearm of claim 1, wherein the takedown lever engages the slide when in the blocking position and the takedown lever does not engage the slide when in the unblocking position.

4. The firearm of claim 1, wherein the takedown lever includes a mounting end pivotably coupled to the firearm, an opposite free end defining a grasping portion, and a blocking surface interposed between the mounting and free ends; and wherein the blocking surface abuttingly engages the slide when the takedown lever is in the blocking position to prevent movement of the slide from the forward position to the rearward removal position.

5. The firearm of claim 4, wherein the blocking surface of the slide takedown lever is forward facing and engages a corresponding rearward facing blocking surface disposed on a front end of the slide.

6. The firearm of claim 5, wherein the rearward facing blocking surface of the slide is defined on an enlarged boss extending downwardly from the from end of the slide.

7. The firearm of claim 1, wherein the takedown lever is retained in the blocking position via a spring loaded retaining mechanism.

8. The firearm of claim 1, wherein the slide includes at least one guide rail disposed near a rear end of the slide that slidably engages a corresponding guide flange disposed in the frame, the guide rail and guide flange interacting to retain the slide on the frame and prevent removal of the slide from the frame when the slide is in the forward position.

9. The firearm of claim 8, wherein the rear end of the slide further includes a recess including a longitudinally-extending guide slot and an enlarged downwardly open receptacle communicating with the guide slot, the guide flange in the frame being slidably moveable from the guide slot into the receptacle when the slide moves from the forward position to the rearward removal position.

10. The firearm of claim 9, wherein the takedown lever engages a rearward facing blocking surface defined on an enlarged boss extending downwardly from a front end of the slide when the takedown lever is in the blocking position.

11. A firearm with slide takedown mechanism comprising:

a frame;

a barrel supported by the frame and defining a longitudinal axis of the firearm;

a trigger movably supported by the frame;

a reciprocating slide slidably engaged with the firearm, the slide moveable between a forward position and a rearward removal position; and a takedown lever pivotably mounted to the firearm and engageable with the slide, the lever being pivotable in a lateral direction about the longitudinal axis between a blocking position in which the slide is not movable from the forward position to the rearward removal position and an unblocking position in which the slide is movable to the rearward removal position;

wherein when the slide is in the rearward removal position, the slide is configured to be disengageable from the frame for removal;

wherein the takedown lever includes a mounting end pivotably coupled to the firearm, an opposite free end defining a grasping portion and a blocking surface interposed between the mounting and free ends; and wherein the blocking surface abuttingly engages the slide when the takedown lever is in the blocking position to prevent movement of the slide from the forward position to the rearward removal position;

wherein the blocking surface of the slide takedown lever is forward facing and engages a corresponding rearward facing blocking surface disposed on a front end of the slide;

wherein the rearward facing blocking surface of the slide is defined on an enlarged boss extending downwardly from the front end of the slide;

wherein the enlarged boss defines a guide hole configured for slidably receiving a recoil spring guide rod therethrough.

12. A firearm with slide takedown mechanism comprising:

a frame;

a barrel supported by the frame and defining a longitudinal axis of the firearm;

a trigger movably supported by the frame;

a reciprocating slide slidably engaged with the firearm, the slide moveable between a forward position and a rearward removal position; and a takedown lever pivotably mounted to the firearm and engageable with the slide, the lever being pivotable in a lateral direction about the longitudinal axis between a blocking position in which the slide is not movable from the forward position to the rearward removal position and an unblocking position in which the slide is movable to the rearward removal position;

wherein when the slide is in the rearward removal position the slide is configured to be disengageable from the frame for removal;

wherein the takedown lever includes a mounting, end pivotably coupled to the firearm, an opposite free end defining a grasping portion, and a blocking surface interposed between the mounting and free ends;

wherein the blocking surface abuttingly engages the slide when the takedown lever is in the blocking position to prevent movement of the slide from the forward position to the rearward removal position;

wherein the blocking surface is disposed beneath the barrel and is pivotably moveable into and out of the frame of the firearm.

13. A firearm with slide takedown mechanism comprising:

a frame;

a barrel supported by the frame and defining, a longitudinal axis of the firearm;

a trigger movably supported by the frame;

a reciprocating slide supported by the frame for axial movement between a forward position and a rearward removal position, the slide configured to be removable from the frame when in the rearward removal position; and a takedown lever pivotably mounted to the firearm and engageable with the slide, the takedown lever including a mounting end pivotably coupled to the firearm, an opposite free end defining a grasping portion, and a blocking surface interposed between the mourning and free ends;

wherein the takedown lever is movable between a blocking position in which the blocking surface interposed between the mounting and free ends engages the slide to block movement of the slide from the forward position to the rearward removal position, and an unblocking position in which the blocking surface does not engage the slide and allows movement of the slide from the forward position to the rearward removal position;

wherein the takedown lever is mounted about a pivot pin defining a pivot axis oriented parallel to the longitudinal axis of the frame.

14. The firearm of claim 13, wherein the takedown lever is oriented perpendicular to the longitudinal axis of the firearm.

15. The firearm of claim 13, wherein the blocking surface of the takedown lever engages a rearward facing blocking snake defined on an enlarged boss extending downwardly from a front end of the slide when the takedown lever is in the blocking position.

16. The firearm of claim 15, wherein the slide includes at least one guide rail disposed near a rear end of the slide that slidably engages a corresponding guide flange disposed in the frame, the guide rail and guide flange interacting to retain the slide on the frame and prevent removal of the slide from the frame when the slide is in the forward position.

17. The firearm of claim 15, wherein the slide further includes a recess disposed in a rear portion of the slide that slidably engages a corresponding, guide flange disposed in the frame, the recess including a longitudinally-extending narrow guide slot and an enlarged downwardly open receptacle communicating with the guide slot, the guide flange being located in the guide slot when the slide is in the forward position and the guide flange being located in the receptacle when the slide is in the rearward removal position.

18. The firearm of claim 13, wherein the takedown lever is pivotably disposed on an underside of the frame.

19. The firearm of claim 18, wherein the takedown lever retractable into and extendible outwards from within a recess disposed on the underside of the frame within the confines of the trigger guard.

20. The firearm of claim 13, wherein the blocking surface of the takedown lever is defined on a portion of the takedown lever that is physically enlarged with respect to the grasping portion.

21. A method for removing a slide from a firearm including:

providing, a firearm having a longitudinal axis, barrel with bore, trigger, frame, and a reciprocating slide movable forwards and rearwards on the frame;

locating the slide in a forward position;

engaging a takedown lever with the slide wherein the slide cannot be moved rearwards past the forward position, the takedown lever being in a blocking position;

pivoting the takedown lever about a pivot axis oriented parallel to the longitudinal is outwards from the frame and downwards from the blocking position to an unblocking position;

disengaging the takedown lever from the slide;

retracting the slide rearwards on the frame to rearward removal position; and removing the slide from the frame.

22. The method of claim 21, wherein the engaging step comprises abuttingly contacting a rearward facing planar blocking surface disposed on a front end of the slide with a forward facing planar blocking surface disposed on takedown lever.

23. The method of claim 21, wherein the pivoting step comprises pivoting the takedown lever outwards from underneath the frame of the firearm.

* * * * *

UNITED STATES PATENT AND TRADEMARK OFFICE

CERTIFICATE OF CORRECTION

PATENT NO. : 8,950,100 B2
APPLICATION NO. : 13/708711
DATED : February 10, 2015
INVENTOR(S) : Darin Nebeker et al.

It is certified that error appears in the above-identified patent and that said Letters Patent is hereby corrected as shown below:

In the Claims

Col. 12, Claim 12, line 17, delete "," between "mounting" and "end"
Col. 12, Claim 13, line 30, delete "," between "defining" and "a"
Col. 12, Claim 13, line 42, change "mourning" to --mounting--
Col. 12, Claim 15, line 59, change "snake" to --surface--
Col. 13, Claim 17, line 3, delete "," between "corresponding" and "guide"
Col. 13, Claim 21, line 21, delete "," between "providing" and "a"
Col. 14, Claim 21, line 6, change "is" to --axis--

Signed and Sealed this
Twenty-first Day of July, 2015

Michelle K. Lee

Michelle K. Lee
*Director of the United States Patent and Trademark Office*